US009384633B2

(12) United States Patent
Lyons et al.

(10) Patent No.: US 9,384,633 B2
(45) Date of Patent: Jul. 5, 2016

(54) SYSTEM AND METHOD FOR DECOUPLED AND PLAYER SELECTABLE BONUS GAMES

(71) Applicant: Bally Gaming, Inc., Las Vegas, NV (US)

(72) Inventors: Martin S. Lyons, Henderson, NV (US); Bryan M. Kelly, Alamo, CA (US); Ray Maras, Carinbah (AU); Stephen E. Patton, Reno, NV (US)

(73) Assignee: BALLY GAMING INC., Las Vegas, NV (US)

( * ) Notice: Subject to any disclaimer, the term of this patent is extended or adjusted under 35 U.S.C. 154(b) by 0 days.

(21) Appl. No.: 14/961,289

(22) Filed: Dec. 7, 2015

(65) Prior Publication Data

US 2016/0086450 A1 Mar. 24, 2016

Related U.S. Application Data

(63) Continuation of application No. 14/018,292, filed on Sep. 4, 2013, now Pat. No. 9,208,649.

(51) Int. Cl.
*G07F 17/32* (2006.01)

(52) U.S. Cl.
CPC ..... *G07F 17/3258* (2013.01); *G07F 17/3209* (2013.01); *G07F 17/3223* (2013.01); *G07F 17/3246* (2013.01); *G07F 17/3267* (2013.01)

(58) Field of Classification Search
USPC ..... 463/26, 27
See application file for complete search history.

(56) References Cited

U.S. PATENT DOCUMENTS

| | | | | |
|---|---|---|---|---|
| 8,191,009 | B2 * | 5/2012 | Sekiguchi | G06F 3/14 715/806 |
| 2012/0002949 | A1 * | 1/2012 | Matsuura | H04N 5/85 386/248 |
| 2013/0324230 | A1 * | 12/2013 | Iddings | G07F 17/32 463/25 |

* cited by examiner

*Primary Examiner* — Pierre E Elisca
(74) *Attorney, Agent, or Firm* — Philip Anderson; Marvin Hein

(57) ABSTRACT

Various embodiments are directed to gaming systems and methods including a bonus game that can be decoupled from base games and/or are player selectable. Bonus features can be added to existing games and player selection of progressive play can be provided. The method and system can further provide switching among possible links without dynamic reconfiguration.

7 Claims, 8 Drawing Sheets

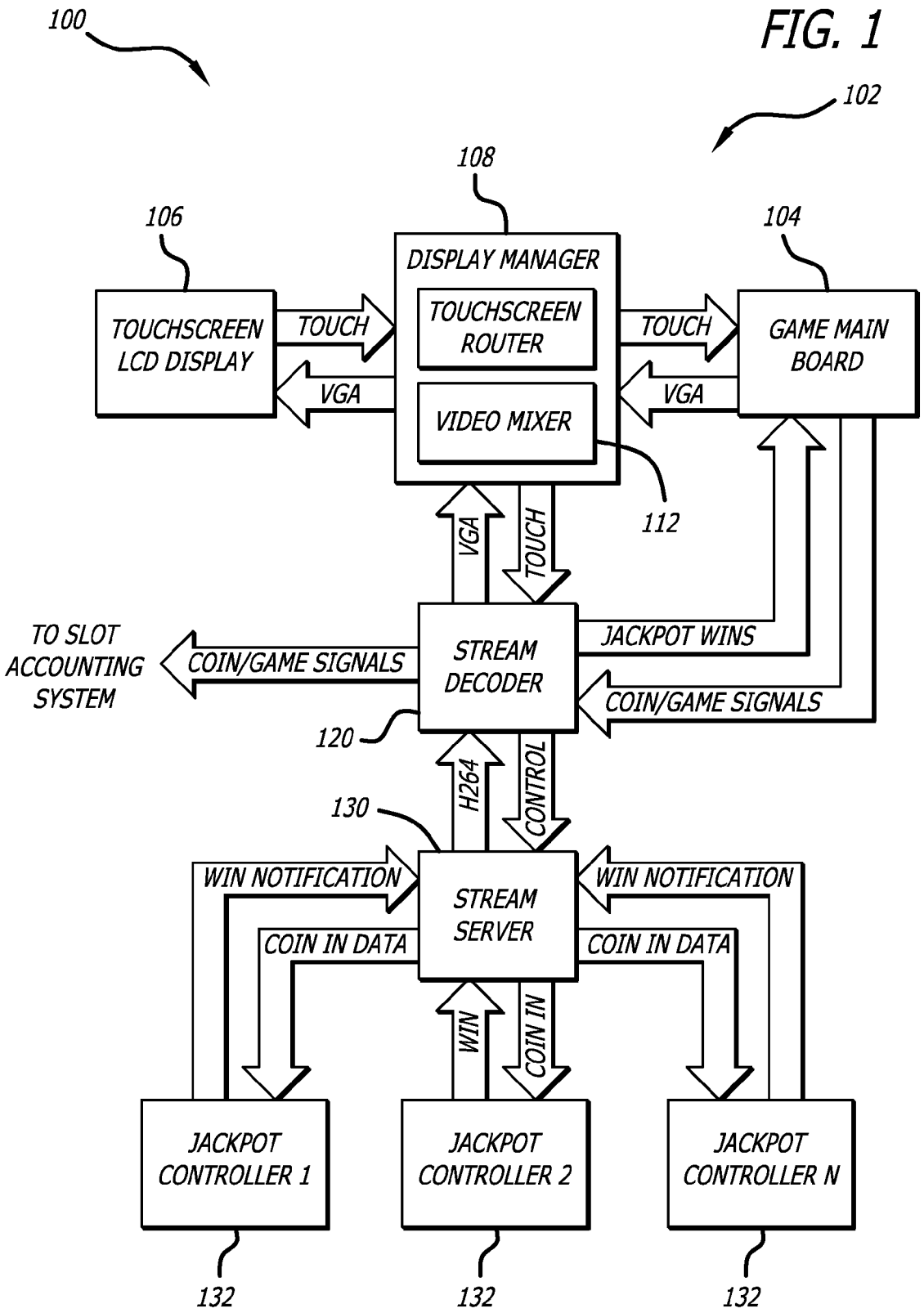
100
FIG. 1
102
108
106
104
DISPLAY MANAGER
TOUCHSCREEN LCD DISPLAY
TOUCH
VGA
TOUCHSCREEN ROUTER
VIDEO MIXER
TOUCH
VGA
GAME MAIN BOARD
112
VGA
TOUCH
TO SLOT ACCOUNTING SYSTEM
COIN/GAME SIGNALS
STREAM DECODER
JACKPOT WINS
COIN/GAME SIGNALS
120
H264
CONTROL
130
WIN NOTIFICATION
STREAM SERVER
WIN NOTIFICATION
COIN IN DATA
COIN IN DATA
WIN
COIN IN
JACKPOT CONTROLLER 1
JACKPOT CONTROLLER 2
JACKPOT CONTROLLER N
132
132
132

500

600

START
LET JACKPOT PERIOD (IN $) BE P
602
CHOOSE R AS RANDOM VALUE BETWEEN 0 AND 2*P
604
SET HIDDEN PROGRESSIVE TRIGGER TO R. SET COUNTER C TO 0
606
RECEIVE BET B FROM CLIENT E
608
C=C+B
610
C>R ?
612
NO
YES
SIGNAL CLIENT E TO BEGIN BONUS ROUND
614
RECEIVE BONUS RESULT FROM E
616
AWARD PRIZE TO E AND RESET JACKPOT
618

START
700
RECEIVE GAME SIGNAL
702
CHANGE JACKPOT TOUCH
SIGNAL TYPE ?
GAME START
GAME END
704
DISABLE GAME
730
DISABLE CHANGE JACKPOT
ENABLE CHANGE JACKPOT
720
706
SET STREAM DECODE TO JACKPOT MENU
708
WAIT FOR SELECTION OR EXIT
710
CHOSEN JACKPOT=N
712
SET STREAM DECODE TO JACKPOT N STATUS
714
SEND CONFIGURE RTP (N) TO GAME
716
ENABLE GAME
FINISH

SYSTEM AND METHOD FOR DECOUPLED AND PLAYER SELECTABLE BONUS GAMES

CROSS REFERENCE TO RELATED APPLICATION

This application is a Continuation application of prior filed U.S. application Ser. No. 14/018,292 filed Sep. 4, 2013 and titled "SYSTEM AND METHOD FOR DECOUPLED AND PLAYER SELECTABLE BONUS GAMES", hereby incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD

This description generally relates to wagering games, gaming machines, and networked systems and methods, and in particular to wagering games, gaming machines, and networked gaming systems having a bonus feature.

BACKGROUND

Casinos and other gaming establishments are continually looking for ways to make gaming fresher and more exciting for their patrons. New approaches for varying existing gaming and for otherwise servicing patrons are highly desirable. For example, certain gaming machines can include a bonus feature. In a progressive slot game, the prize for a particular winning event is increased as players make wagers. Once a player wins the progressive prize, the prize resets to an initial value. Prior progressive gaming systems have linked slot machines together so that the progressive prize(s) are incremented by wagers across a number of machines. These prior gaming systems also included a mystery linked jackpot, which is a jackpot where existing gaming machines are linked to a central jackpot controller that awards a prize periodically to a triggering gaming machine. The mystery aspect of this jackpot is that there is no linkage—from the perspective of the player—between the game outcome at the triggering gaming machine and the prize being awarded at the completion of a game cycle.

The lack of linkage between player action and a mystery prize being awarded has been seen as a deficiency of mystery jackpots. This is because the player lacks anticipation (e.g., the build-up to a win that a player experiences when they participate in a bonus feature) since he or she is unaware of the triggering event that would result in the mystery prize being awarded due to the lack of linkage. Therefore, there remains a need to provide player anticipation for mystery jackpots. There also remains a need to allow for mystery jackpots to be awarded across different platforms (e.g., across competing vendor base games).

Prior progressive gaming systems also do not allow players to choose which progressive jackpot they wish to participate in at a given gaming machine. Rather, players are inconveniently forced to select a gaming machine based on the progressive jackpot available thereon. For example, players may move from a gaming machine on a first progressive link to another gaming machine that is on another progressive link. A major focus of casino operation is concerned with getting players to sit down at a gaming machine and stay there. Any time a player gets up, for whatever reason, there is a chance they will leave the casino or not initiate play again. One problem with such conventional systems, is that jackpot bonus features are required to be embedded within the game software, necessitating a re-approval by gaming regulators. While this may be overcome by including the bonus feature in the initial development of the game, it is known to be desirable to deploy bonus features at a later date, after independently establishing the game itself, as a means of extending the life of a successful game. Furthermore, bonus features are typically developed independently of games.

Accordingly, what is needed is a system or method which decouples bonus features from base games of a game system. An approach which provides a player the ability to select from available bonus features is also needed. The present disclosure addresses these and other needs.

SUMMARY

Briefly, and in general terms, various embodiments are directed to wagering games, gaming machines, networked gaming systems and methods including a bonus feature.

In one approach, a game system can include at least one electronic game machine that displays a base game and a bonus game, a display manager, a stream decoder, a stream server in communication with the stream decoder, and at least one jackpot controller in communication with the stream server, wherein the gaming system decouples the bonus game from the base game.

In a related approach, a method can involve providing at least one electronic game machine that displays a base game and a bonus game, configuring a display manager to communicate with functionality of the electronic game machine, providing a stream decoder, connecting a stream server to communicate with the stream decoder, placing at least one jackpot controller in communication with the stream server, and decoupling the bonus game from the base game.

The system or method can further include or involve one or more player selectable bonus games as well as choosing bonus games by moving between available links. Further, progressive jackpots can be guaranteed within a certain period of play and jackpot controllers can accumulate information so that no dynamic reconfiguration is necessary when switching from one link to another. Moreover, a plurality of electronic game machines can be configured to communicate with a single jackpot controller, or a stream server can be configured to communicate with a plurality of jackpot controllers.

In other respects, there can be incorporation of player selection of progressive play that allows players to feel in control, or keep playing a hot machine after a progressive hits. Automatic matching of suitable base game return to player to progressive return to player with invalid combinations is not allowed or can be prohibited. Further, the system or method is contemplated for the use of a display manager to add a bonus feature to an existing game, and interactive bonus games can be played on mystery triggers. Moreover, it is contemplated that progressive jackpots can be guaranteed to hit within a certain period of play, while still allowing interactive (non-predetermined) bonus games.

Other features and advantages will become apparent from the following detailed description, taken in conjunction with the accompanying drawings, which illustrate by way of example, the features of the various embodiments. Of course, the foregoing summary does not encompass the claimed subject matter in its entirety, nor are the embodiments intended to be limiting. Rather, the embodiments are provided as mere examples.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

FIG. 1 is a schematic view of a game system organization according to one illustrated embodiment;

DETAILED DESCRIPTION

Figure 2:
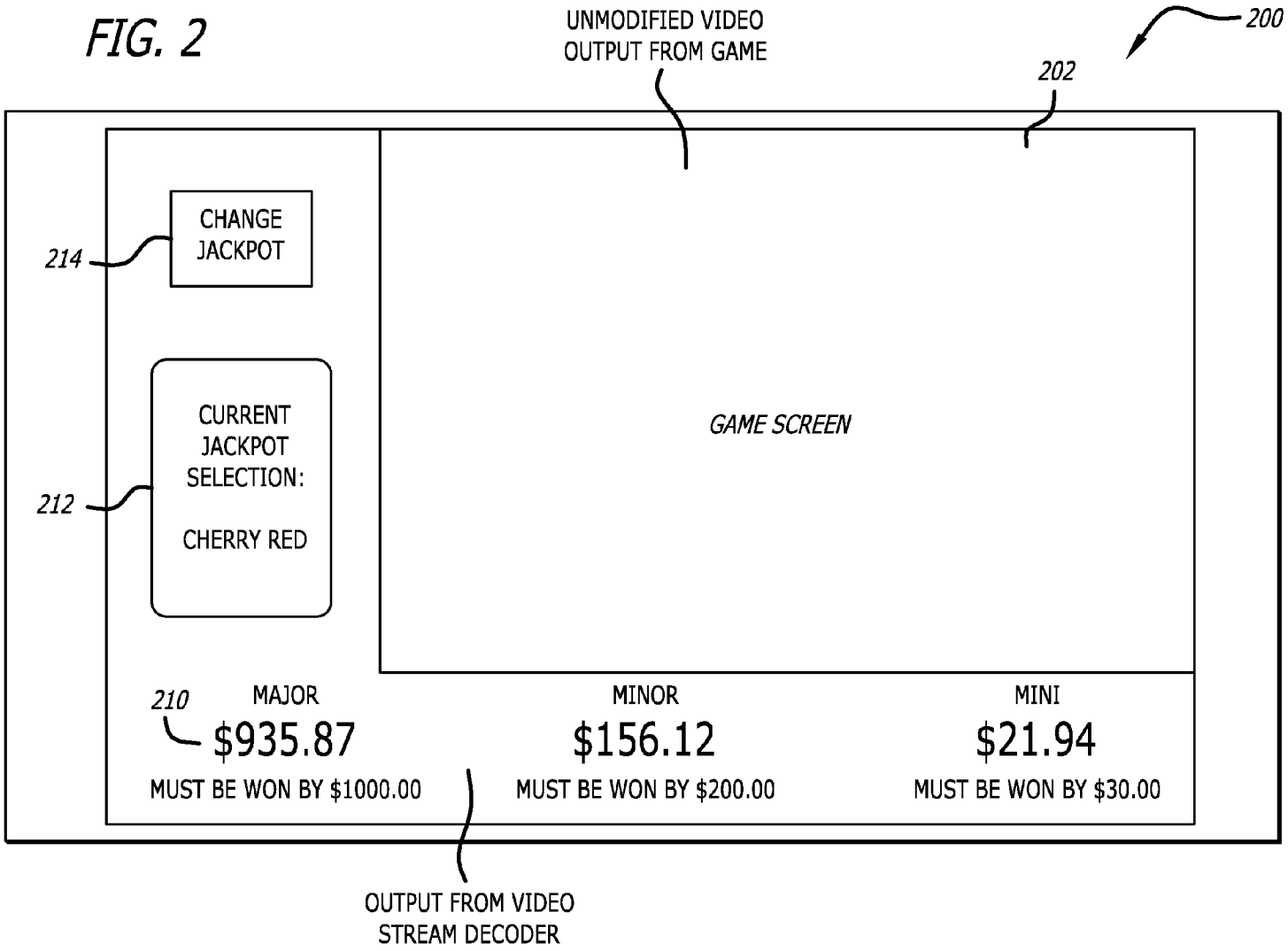
FIG. 2 is a schematic diagram of a video output of a game machine.

In the following description, certain specific details are set forth in order to provide a thorough understanding of various disclosed embodiments. However, one skilled in the relevant art will recognize that embodiments may be practiced without one or more of these specific details, or with other methods, components, materials, and the like. In other instances, well-known structures associated with servers, networks, displays, media handling and/or printers have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

As used herein the term "physical" refers to tangible elements associated with a game. Such elements may take a variety of forms, including but not limited to playing cards, chips, dice, tiles, spinners, tokens or markers for instance chess pieces, checker pieces, pieces that represent players, houses in Monopoly, ships in Battleship, wedges in Trivial Pursuit, and the like.

As used herein, the term "virtual" refers to a logical construct of an element associated with a game and a visual display of the logical construct, where there is no physical counterpart to the particular element in use in the game as the game is being played. For example, a virtual game layout refers to the logical construct of a layout of a game and the visual display of the game layout (e.g., demarcations typically found on a board or felt).

As used here in the term "representation" or "visual representation" refers to a visual display of an icon or other graphical element that is representative of a physical object associated with a game. For example, a visual icon may be displayed representing a physical playing card, physical chip or physical dice that are in use in the game.

As used herein, the terms "touch screen," "touchscreen," or "touch screen display" refer to any touch device or any electronic visual display that can recognize a touch event from a user (e.g., using one or more fingers, or a stylus), such as but not limited to, a resistive touch screen, a surface acoustic wave (SAW) touch screen, a capacitive sensing touch screen, an infrared touch screen (e.g., an infrared acrylic projection touch screen), an optical imaging touch screen, touch screens that detect piezoelectricity, or acoustic pulse recognition touch screens.

Progressive slot machine games have existed for over thirty years. In a progressive slot game, the prize for a particular winning event is not fixed, but instead increases as players make wagers. Once a player wins the progressive prize, the prize resets to an initial value. A couple of early innovations were to link slot machines together such that the progressive prize(s) were incremented by wagers across a number of machines, and the 'mystery' linked jackpot, first described by Frankovic, where existing slot machines, not necessarily with progressive winning combinations, are linked to a central jackpot controller that awards a prize periodically to a triggering electronic gaming machine. The 'mystery' aspect of this jackpot is that there is no linkage between the game outcome at the triggering EGM and the prize being awarded. From the perspective of the player, at the completion of a game cycle, no matter whether the game result in a win or loss, a prize may be awarded by the jackpot controller.

As stated, the lack of a link between player action and a mystery prize being awarded has been seen as a deficiency of mystery jackpots. It is commonly known that even current mystery solutions suffer from the lack of "anticipation", that is, the build-up to a win that a player experiences when they participate in a bonus feature. Attempts have been made to overcome this problem. For example, there are systems which provide a jackpot bonus feature that the player interacts with before the jackpot is awarded. One problem with this approach, however, is that it requires the jackpot bonus feature to be embedded within the game software, necessitating a re-approval by gaming regulators. While this may be overcome by including the bonus feature in the initial development of the game, it is a known strategy to deploy such bonus features at a later date as a means of extending the life of a successful game. Furthermore, bonus features are typically developed independently of games so while it is entirely possible to have, for example, an "Emerald City" base game with either a "Cherry Red" bonus feature or a "Bullseye Bonus" bonus feature, for example, in practice, only one feature is ever deployed with one game because of the need to get every possible combination of game and feature approved in every jurisdiction.

A further problem with the prior approaches or other solutions is that unlike the original Frankovic mystery system they do not work across competing vendor base games. That is, the interactive nature of the bonus game cannot be integrated with an arbitrary game.

In one approach, streaming gaming technology can be employed to achieve desired results. In another approach, without streaming technology, a system or method would require multiple sets of large amounts of graphical assets (as typically found in progressive jackpot bonuses) to be deployed to each EGM in the link. It would also require this deployment to be repeated when a new progressive bonus was added.

FIG. 1 depicts one manner in which a system or method 100 with functionality to decouple bonus games from base games can be organized and with streaming in mind.

The jackpot system 100 includes a gaming machine 102 having a processor 104, a display 106, and a display manager 108. The display manager 108 may include a touchscreen router and a video mixer 112. The display 106 may be any display capable of presenting graphical information (e.g., content) to a player with or without touchscreen capabilities. For example, according to some embodiments, the display 106 may be a touchscreen LCD display. As shown, the display manager 108 is in communication with the display 106 and the processor 104. The content that would normally be displayed via the display 106 may be reformatted by the display manager 108. The display manager may provide controlled video mixing between two or more video inputs and may re-map touch screen inputs. A gaming machine (e.g., EGM) may be connected to a display manager and not be aware that other content is being displayed and interacted with on the primary display of the gaming or game machine. For example, the display manager 108 may combine the content typically presented on a plurality of displays on a gaming machine, such as the top box frame graphical data, main screen graphical data, and virtual button deck graphical data.

The system or method 100 can complement or incorporate existing Display Manager (DM) products such as those disclosed in U.S. Pat. No. 8,241,123, titled Video Switcher and Touch Router Method For A Gaming Machine, and U.S. Pat. No. 8,475,273, titled Video Switcher and Touch Router System For A Gaming Machine, each of which are incorporated herein by reference. Generally, the DM provides software controlled video mixing between two video inputs and remaps touchscreen inputs.

The stream server may send compressed data (e.g., compressed graphical data and compressed audio data), and to the streaming decoder over, for example, a wired or wireless network. In this regard, the systems and methods disclosed herein may utilize or otherwise be complemented by the teachings disclosed in commonly owned U.S. patent application Ser. No. 13/273,555, titled Streaming Bitrate Control and Management. Accordingly, U.S. patent application Ser. No. 13/273,555 is hereby incorporated in its entirety by reference. The systems and methods disclosed herein may utilize or otherwise be complemented by the teachings disclosed in commonly owned U.S. patent application Ser. No. 13/273,611, titled Graphics Processing Unit Memory Usage Reduction. Accordingly, U.S. patent application Ser. No. 13/273,611 is hereby incorporated in its entirety by reference.

In the current approach 100, the DM is connected to or part of the EGM 102 and also communicates with suitable streaming decoder hardware. A Bally IView 3.0 is one possible streaming decoder, but it also may be preferable to use a SoC (System on Chip) as found in everything from smart mobile phones to TV set-top boxes. The streaming decoder 120 is only or selectably responsible for decoding a video stream and passing control/coin signals between the EGM and a stream server 130. In FIG. 1, for ease of understanding, only one EGM/DM/streaming decoder combination is shown connected to the stream server 130. In operation, it is expected that many EGM/DM/stream decoder combinations could be connected to a stream server 130.

The stream server shown in FIG. 1 can be configured to interact with existing (un-modified) jackpot controllers (such as those produced by Bally. It renders video graphics which are encoded within the server using either hardware or software video compression. Typically this compression is a variant of the H.264 standard or equivalent in performance. The stream server 130 can render multiple streams, the details of which are described below.

From the user's perspective, the system or method 100 operates as follows. During normal play, the user is presented with a display 200 as shown in FIG. 2. Most of the display is taken up with the existing game video output, which is shown Picture-in-Picture (PiP) by the DM. Any touchscreen presses on the game screen area 202 are re-mapped and passed to the game touchscreen input. The rest of the screen is composed of elements rendered and encoded by the stream server, and decoded by the stream decoder. In the typical example shown in FIG. 2, this consists of current jackpot values 210, an informational panel that advertises the currently selected jackpot link 212 and a touchscreen 214 button allowing the player to change the active jackpot link.

It should be noted that for efficiency reasons, during normal (non bonus award mode) operation the same stream may be sent by the streaming server to all stream decoders associated with the EGMs participating in a particular link.

Figure 3:
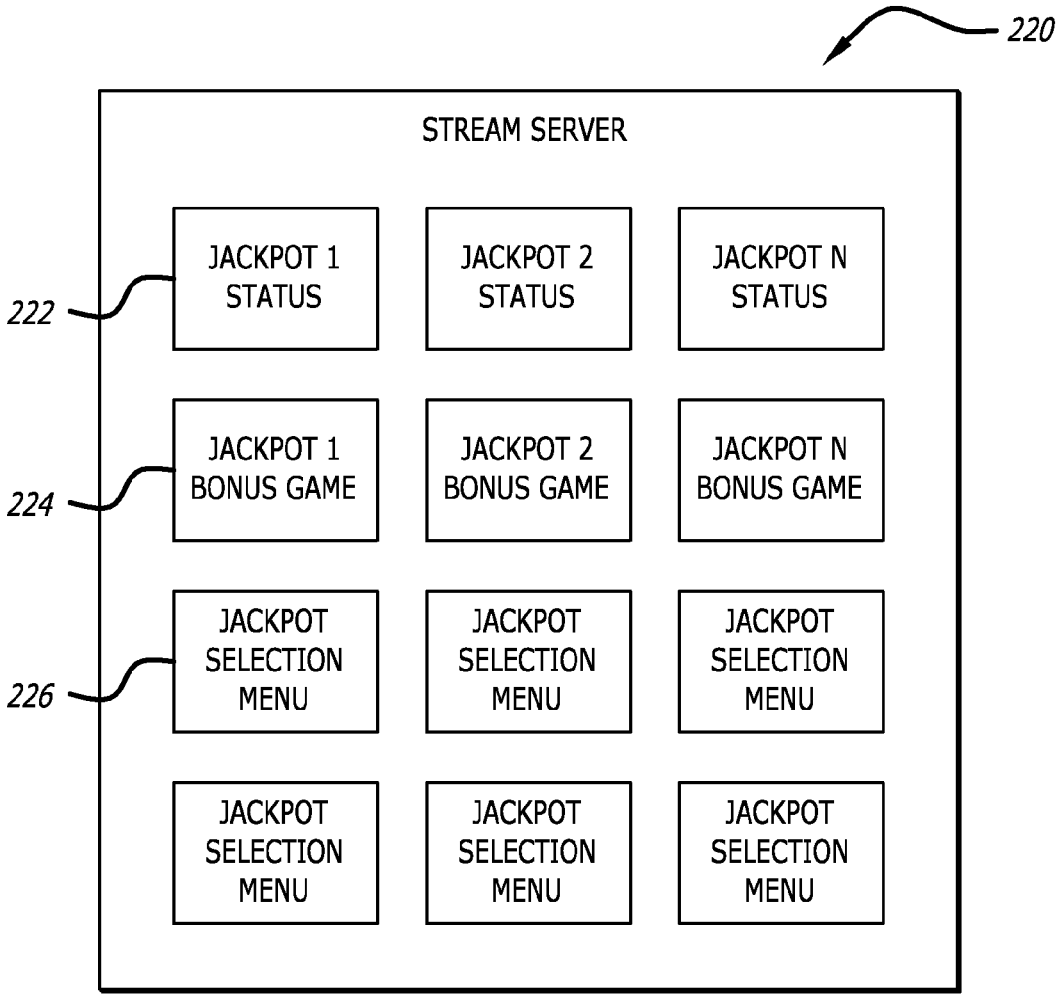
FIG. 3 is a schematic diagram of an example stream of a stream server.

FIG. 3 illustrates an example 220 of the streams that are being generated at any one time by the stream server. For each jackpot link there is exactly one 'status' stream 222 being generated. This contains the current jackpot values and is sent to every decoder associated with an EGM participating in that link. For each jackpot link there may be exactly one 'bonus game' stream 224 being generated. Finally, there are a number of 'selection menu' streams 226 being generated.

Figure 4:
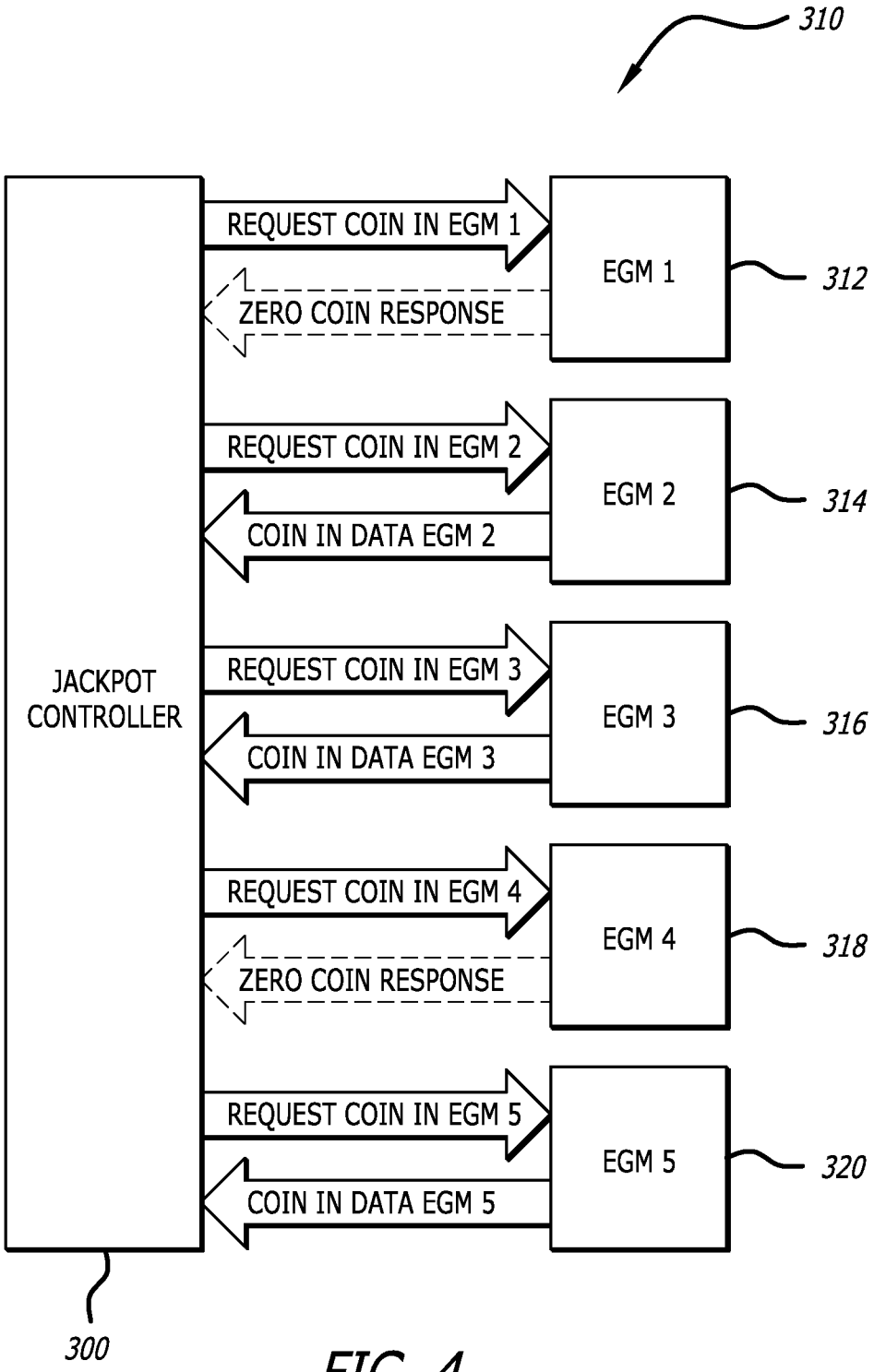
FIG. 4 is a schematic diagram of an interaction between a jackpot controller and an EGM.

Further, with respect to how this approach may operate in terms of interaction with existing jackpot controllers, FIG. 4 first depicts the coin-in accumulation interactions between a conventional or other jackpot controller 300 and an existing set of EGMs 310. The jackpot controller 300 polls each EGM 310 in turn and either receives the amount of coin-in since the last poll (which may in turn trigger a jackpot and further interaction) or a response indicating that no play has occurred at the EGM 310. In this example, EGM 2 314, EGM 3 316 and EGM 5 320 have coin in data to pass to the jackpot controller, while EGM 1 312 and EGM 4 318 send empty responses. If a coin-in causes a jackpot to trigger, the jackpot is transferred to the EGM and reset to its starting amount within the jackpot controller 300.

Figure 5:
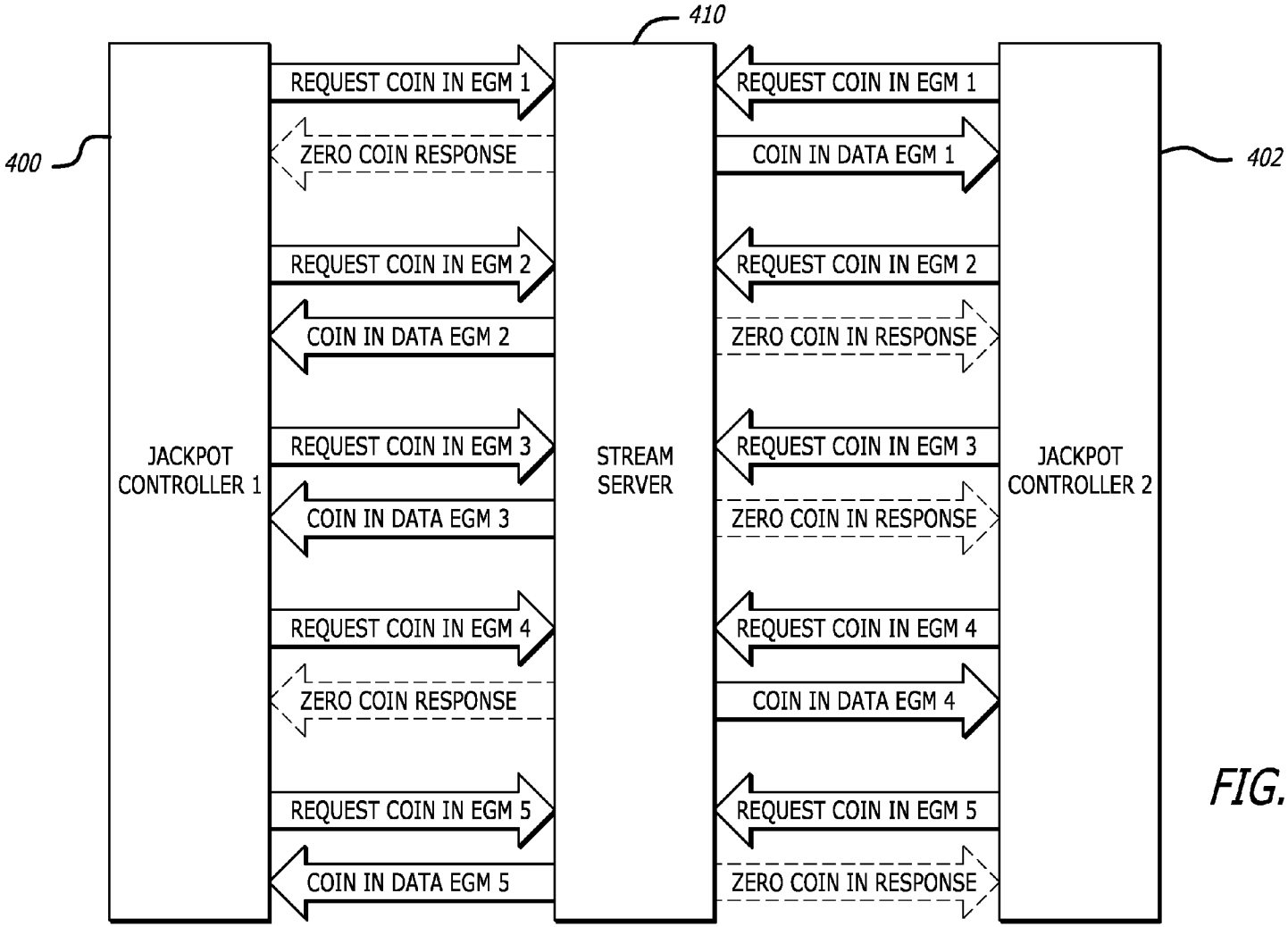
FIG. 5 is a schematic diagram of a multiple jackpot controller interaction with a stream server.

Referring now to FIG. 5, another approach can involve multiple jackpot controllers 400, 402. Again, each jackpot controller 400, 402 queries each EGM in turn. In this approach, however, the jackpot controller is not querying EGMs directly. Instead, the stream server 410 handles the transaction. In the example shown in FIG. 5, at one particular juncture, players at EGM 2, EGM 3 and EGM 5 have elected to play the jackpot link controlled by Jackpot Controller 1 and players at EGM 1 and EGM 4 have elected to play the jackpot link controlled by Jackpot Controller 2. Each jackpot controller has, however, been configured as if all 5 EGMs were connected to it.

Configuring all or a certain number of jackpot controllers to accumulate coin-in from all EGMs means that no dynamic re-configuration is necessary when a player switches from one link to another. As each jackpot controller polls its attached 'EGMs' (in fact the stream server in all or certain cases), the stream server 410 responds with coin-in data for each EGM that is active on the link associated with the jackpot controller in turn. If no coin in event occurs for a particular EGM since the last collection cycle, or the EGM is currently participating in another jackpot link, an empty or zero response is returned.

Figure 6:
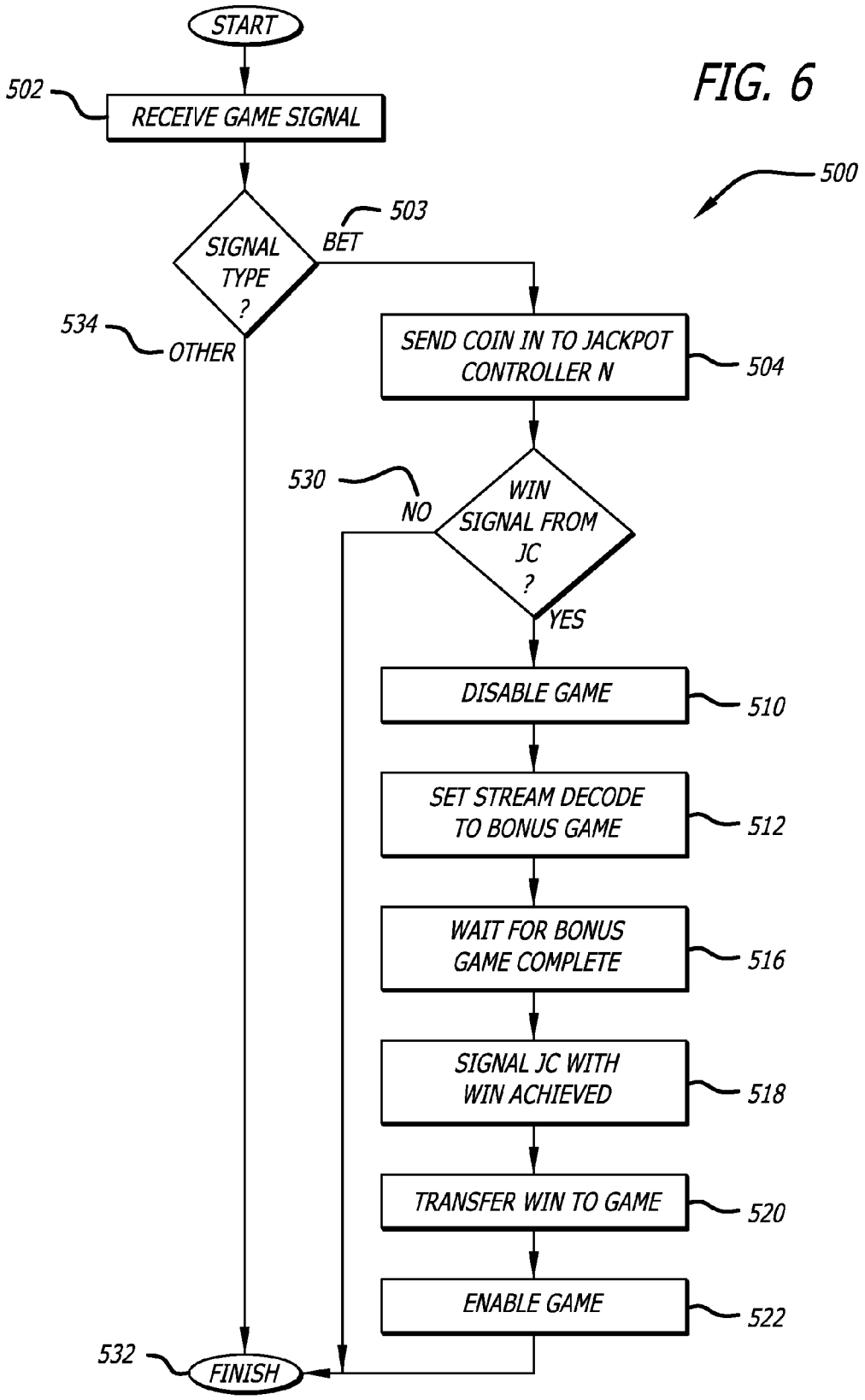
FIG. 6 is a flow chart of a decoupled bonus stream server process.

FIG. 6 shows an example of the overall control process 500 that the stream server performs. A signal 502 is sent by the game after a bet 503, usually at the start of a game cycle, but in some implementations (such as SAS) after the game has completed. This signal indicates the total wager made, and is conventionally fed to the jackpot controller 504 to increase the jackpot meter(s) and potentially cause a jackpot trigger.

It is a feature of this disclosure that after the coin-in data from the bet signal is sent to the indicated jackpot controller (for example using the polling process shown in FIG. 5) a 'jackpot triggered' response from the jackpot controller is used to start an interactive bonus game. There are two potential types of response that a jackpot controller may make. First, it may award a jackpot prize directly, as described in the original Frankovic method. In this scenario, the jackpot controller is operating as a 'Mystery' jackpot controller with preferably more than one jackpot. For example, these jackpots may be labeled 'Major', 'Minor' and 'Mini'. The jackpot controller indicates to the stream server which jackpot has been won and the amount to be awarded to the player. At this point, the stream server disables the base game 510 and switches the stream decoder to start decoding a bonus game sequence 512 that may either be pre-rendered or preferably be interactively generated by a bonus game instance present on the stream server. Ideally, the stream decoder also changes the PiP mode such that the bonus game fills the screen, completely removing the base game video 516. Next, the jackpot controller is signalled where there is a win 518, followed by transferring a win to the game 520 and thereafter again enabling the base game 522.

Where there is no win signal 530, that process can provide directly to finish 532. The process also finishes where other signals 534 such as non-bet signals are processed.

It is preferred for only one player to play a jackpot bonus game at any one time to prevent disputes amongst players when two bonus games occur simultaneously, and only one can win the pre-reset amount (the second player receiving the post-reset amount). In the case where the jackpot bonus instance is already being used by a first player, the second player may receive a "please wait" message until the first bonus instance is completed.

Because only one player can play the jackpot bonus game at any one time, there only needs to be one active bonus game instance operating at any time on the server for each jackpot link, as shown in FIG. 3. If there is more than one instance, the players may alternatively or additionally, be able to select to share or battle for a bonus.

In the case of a Frankovic mystery award, the level won, and its associated prize amount is known by the bonus instance at the commencement of the bonus game, so bonus games should be used that do not involve player selection. An example would be a spinning wheel game, where each segment of the wheel represents one of the types of jackpot (e.g., "Major", "Mini" or "Minor"). The player would spin the wheel, and the wheel would stop at an indicated position pre-determined by the jackpot controller. This would give the player an interactive, anticipatory experience not present in current Mystery solutions without any change to base game or jackpot controller functionality.

Alternatively, the jackpot controller may leave the choice of which level to award to the stream server. In this scenario, a jackpot win (of any level) is triggered at random at a predetermined average rate, and the bonus game instance chooses the level of the jackpot to be awarded based upon some rules. Ideally, these rules allow interactions by the player that although random, are influenced by player choice. For example, the well known bonus feature of uncovering tokens until a certain number match each other.

Figure 7:
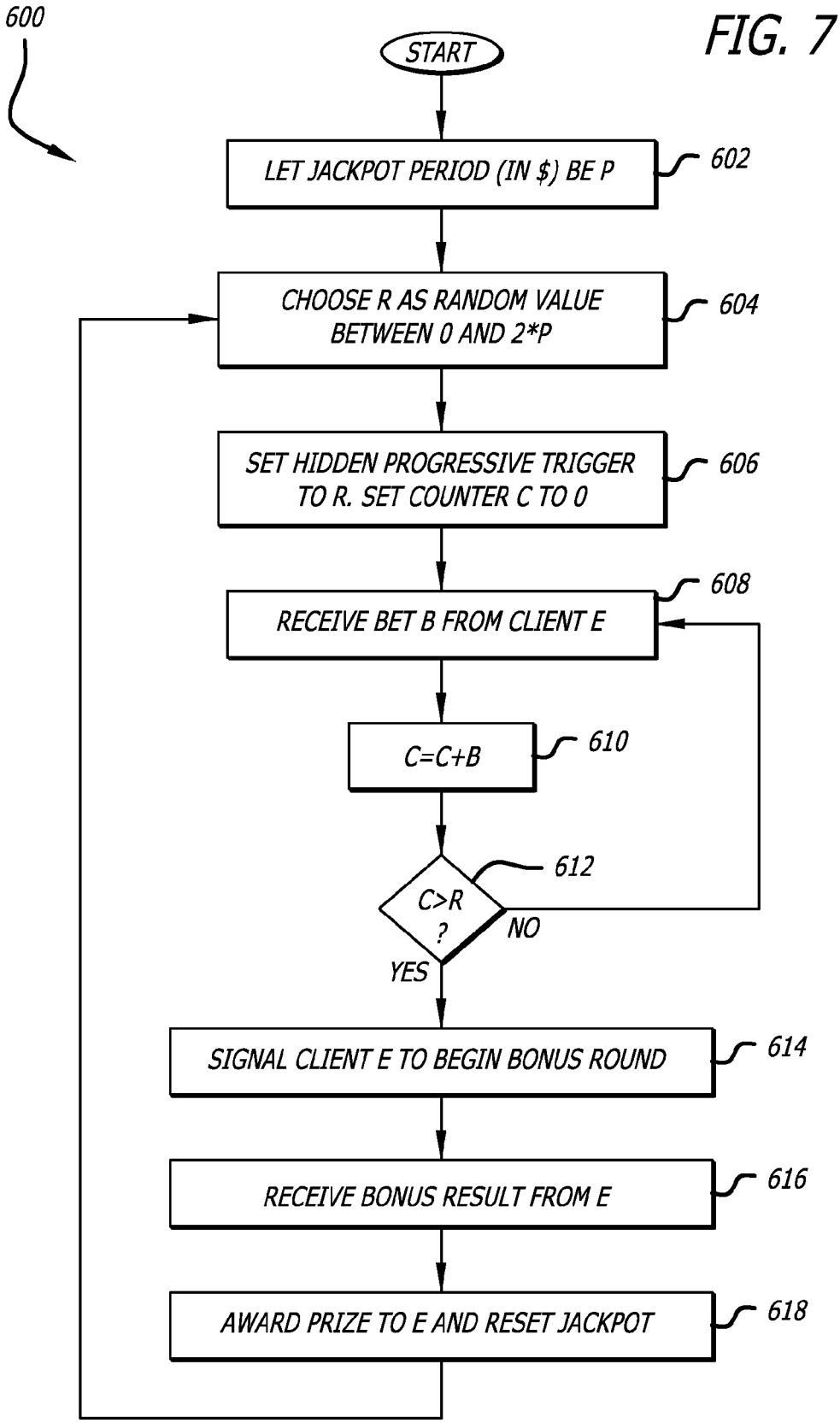
FIG. 7 is a flow chart of a jackpot controller process.

FIG. 7 describes a further process 600, implemented by a jackpot controller, for the periodic awarding of one of a set of jackpots, with a particular jackpot in the set then selected by a client (such as a bonus game instance). The process in FIG. 7 compared to existing methods is that unlike existing methods it has a fixed maximum period between jackpot awards. In contrast, existing methods may theoretically go long periods of time in-between awards. While this leads to potentially higher jackpots, it can frustrate players who may start to believe that a jackpot is rigged.

In FIG. 7, a period (P) 602 is established. This is the amount of turnover (or coin-in) that, on average, will trigger a jackpot or bonus feature to be awarded. The reset and increment value(s) of the jackpot(s) associated with this link along with desired RTP for the jackpot(s) can be used to determine a suitable P value. Alternatively, RTP may be derived from P, reset amount(s) and increment value(s).

At the start of a jackpot cycle, when any of the jackpots are reset, R is then chosen to be a random number between 0 and 2*P (604). R thus, in probability terms, has an expected value of P. A hidden trigger amount is set to R, and a hidden counter C is set to 0 (606). It is noted that unlike with a Frankovic Mystery, R and C bear no direct relation to displayed jackpot amounts.

The progressive cycle may now proceed. As bets (B) are received from EGMs (E) (or in this implementation, from the stream server) 608 they are added to the C counter 610. Once C>R (612), the bonus round is triggered at the client. Again it should be noted that B being added to C is independent of some portion of B being added to the progressive values. This method is thus also applicable for jackpots with a fixed value (such as $1,000,000) as well as progressives.

The client E performs the bonus round 614 and a jackpot level to be awarded is chosen 616. This is passed back to the jackpot controller, causing prize associated with the jackpot level in question to be awarded and the level in question to be reset 618.

Returning to the process in FIG. 6, once the bonus game has been performed and completed the stream decoder resumes displaying jackpot values. The PiP mode is re-enabled, along with the base game functionality.

Accordingly, with these approaches, games may have multiple bonus games configured without needing to change any base game hardware/software or have each game loaded into the DM. Moreover, bonus games may be approved by regulators independent of base game and bonus games may be changed without changing base game. Further, existing jackpot controller infrastructure can be utilized and there need not be re-configuration of jackpot controllers to add and remove EGMs from links. Thus, relatively cheap, optimized streaming solution are made available, over where minimum number of streams are used, and involve no expensive client requirement. In this way, more exciting mystery bonus experiences are provided as is greater anticipation of win during bonus round rather than simply dumping money onto the credit meter.

The currently preferred implementation are contemplated to employ existing or newly developed jackpot controller hardware, DM technology, and perhaps a streaming decoder such as the Nvidia Tegra 2. Moreover, a streaming server based around a suitable compression codec that is low in CPU/GPU load and can generate 2 streams per jackpot link plus as many menu streams can be employed as desired.

A further problem with existing gaming systems is that they do not allow players to choose the progressive jackpot in which they wish to participate. In practice, players do make this choice by moving from an EGM on a first link to another on another link. They make this move usually when the progressive jackpot is triggered, as a savvy player will know that a reset jackpot has a lower RTP than a jackpot closer to its maximum, or with a value farther from its reset value. It is thus contemplated that a gaming system or method can be configured to allow a player to remain at their current EGM while choosing to participate in a different progressive jackpot or jackpots. A major focus of casino operation is concerned with getting players to sit down at an EGM and stay there. Any time a player gets up, for whatever reason, there is a chance they will leave the casino. Thus, an approach which reduces the possibility of such movement is desirable to casinos.

Again, as indicated above, the use streaming gaming technology is contemplated as are approaches without streaming technology. FIG. 1 illustrates how the contemplated approach could be organized with streaming in mind. As shown in FIG. 1, the approach contemplates use of a Display Manager (DM) product, stream decoders 120, a stream server 130 and multiple jackpot controllers 132.

As previously stated, during normal play, the user is presented with a display 202 as shown in FIG. 2. Most of the display is taken up with the existing game video output, which is shown Picture-in-Picture (PiP) by the DM. Touchscreen presses on the game screen area are re-mapped and passed to the game touchscreen input. Current jackpot values 210, an informational panel that advertises the currently selected jackpot link 212 and a touchscreen button 214 allowing the player to change the active jackpot link are further displayed.

If a player touches the "change jackpot" button 214, a notification is sent by the stream decoder 120 to the stream server 130 (See also FIG. 1). Alternatively, all touchscreen presses may be sent to the stream server 130 which determines if the touch is within the area of the "change jackpot" button 214. Once a player has selected "change jackpot" the stream sent to the stream decoder 120 for this particular player is switched to a menu showing available jackpots that the player may play. Preferably, the "change jackpot" button 214 is not active during the game spin cycle. Also, the "change jackpot" button 214 may have a highlight that is toggled to indicate when it is available to be pressed. In terms of streams, this may be achieved by the stream server rendering two streams, one with the button highlighted and one with it inactive. Each stream decoder 120 will receive the stream with the highlighted button or inactive button depending upon the game state.

In one approach, the menu stream is rendered to only show jackpot links that are compatible with the game being played. A particular jackpot link may not be compatible if the combination of return to player (RTP) from game and RTP from jackpot link exceeds a maximum RTP or does not exceed a minimum RTP. For example, if a jurisdiction allows a maximum of 95% RTP, and the game has an RTP of 93%, then only jackpot links with an RTP of <2% will be populated in the menu to be rendered by the stream server. Furthermore, if a game is available with multiple configurations of RTP, a suitable game RTP may be set for each jackpot link. These combinations may be encoded in a table; the following example shows three games and three links, and how they may be configured.

In this example, "American Eagle" is a game with pay tables loaded with RTPs of 88%, 90% and %92; "Mighty Galleons" has pay tables with RTPs of 90%, 92% and 94% and "Cash Blast" has pay tables with RTPs of 92%, 94% and 96%. The casino does not want a game/jackpot combination to exceed 96% RTP.

| | GAME | | |
|---|---|---|---|
| JACKPOT | AMERICAN EAGLE | MIGHTY GALLEONS | CASH BLAST |
| CHERRY RED - 6% | 88% | 90% | 92% |
| MONEY VAULT - 4% | 90% | 92% | 94% |
| TOWER OF POWER - 2% | 92% | 94% | 96% |

So if a player was playing "Cash Blast" and selected the "change jackpot" button, they would only be presented with a menu consisting of "Money Vault" and "Tower Power". "Cherry Red" would not be presented because the combination of jackpot and game would exceed 96% RTP.

After the player selects the new jackpot link from the menu, if necessary the game is re-configured to the new payout RTP. This re-configuration is performed by a Command Center (BCC) (such as G25) command being sent to the game. Some jurisdictional regulations do not allow RTP re-configuration without no play for 4 minutes. However, there can be a specific exemption where the re-configuration is at the demand of the player. This scenario is covered by the disclosed approach as the overall RTP may remain the same, and if it does not, a message can be displayed to the player indicating the RTP change.

Once the jackpot change has been finalized, the player then receives a stream from the stream server with the new jackpot values and advertisements. Because the stream server is already generating this stream, there is no delay between the player selecting the jackpot link and returning to play.

With reference again to FIG. 3, there are shown streams that are being generated at any one time by the stream server. These can be used 'on demand' as players enter the selection menu. A suitable number of menu streams are provisioned, to cope with edge cases of lots of simultaneous menu access. If all menu streams are being used by other players, another player trying to access the selection menu can be prevented from doing so. This can be performed by disabling all 'change jackpot' buttons across the status streams until a player leaves the selection menu. To aid this, there can be a time-out within the selection menu process to return the player to the previous jackpot link and normal play if no action is performed within a certain period, for example say, 2 minutes.

Figure 8:
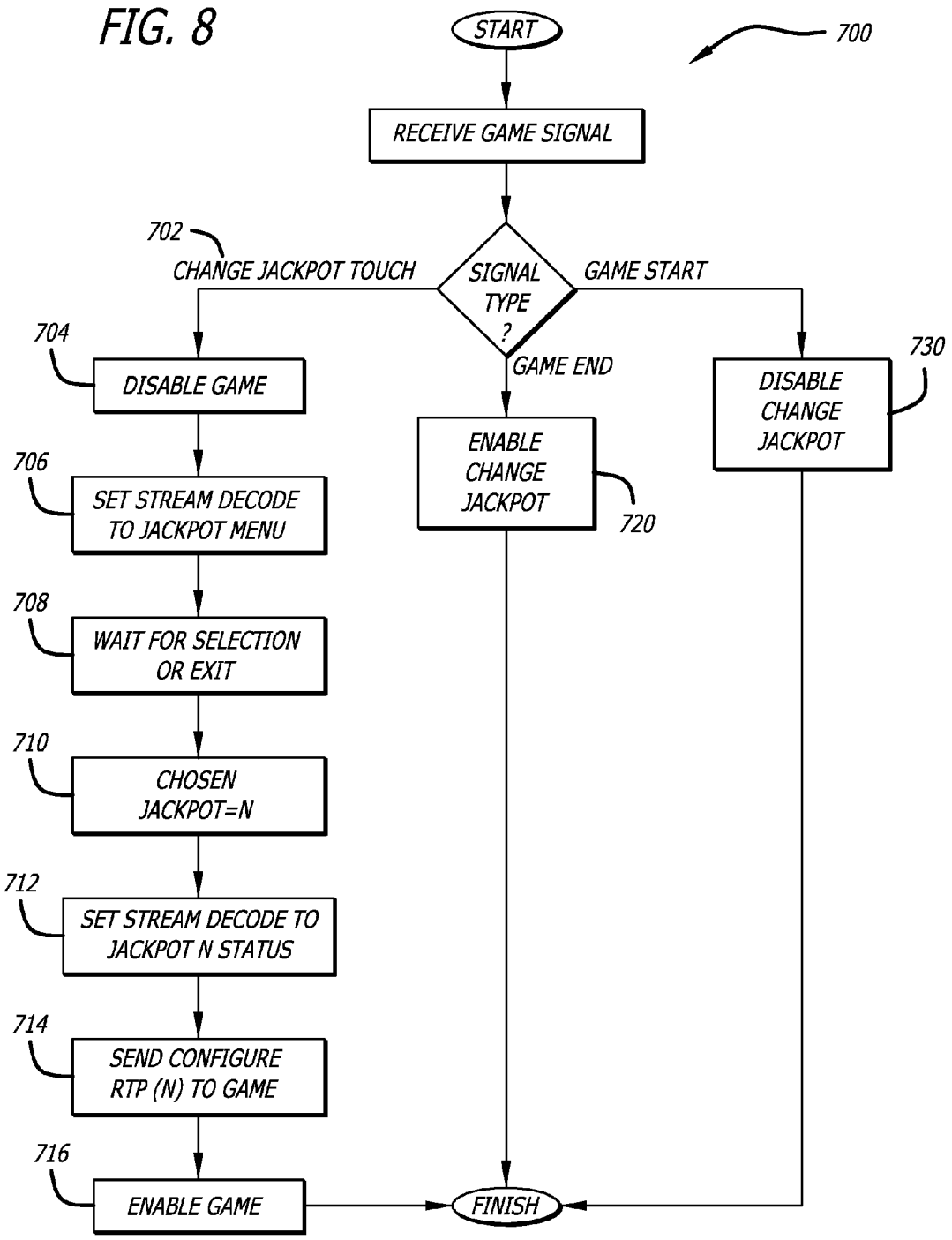
FIG. 8 is a flow chart of a stream server control process.

FIG. 8 illustrates an example of the overall control process 700 that the stream server performs. There are three main classes of signals that it responds to. If there is a valid touch of the display within the area of the "Change Jackpot" virtual button 702, the following steps occur:

Firstly, the base game is disabled. This is done by sending a SAS, G2S or equivalent 'Disable Game' message 704 to the base game. Next a jackpot menu instance is initialized 706. In practice, this instance will already be executing, the initialization consists of passing a list of valid jackpot links (as determined using a table such as shown above) to the instance. The instance starts rendering the menu, and this menu becomes the active stream for the stream decoder. The menu can be displayed across the whole of the game display, so a signal is sent to the DM to disable PiP and only display output from the streaming decoder.

The stream server then passes all touchscreen input to the menu instance, and time is provided for selection 708. Once a selection of the new jackpot link is made, the chosen link (N) 710 is used to determine the jackpot status stream to be sent to the stream decoder 712. If re-configuration of the base game RTP is required, a suitable G2S or BCC message is sent to the game software 714. Finally, the game is re-enabled 716 and PiP mode is re-activated.

Returning to the top of the flowchart in FIG. 8, the two other classes of signals cause the "change jackpot" button to be enabled 720 or disabled 730. These are messages sent over SAS/G2S at the beginning and end of a game cycle. Disabling jackpot changes during a game is not strictly necessary, but can be provided to prevent a potential ambiguity where a player could change the jackpot during a game cycle which would make it unclear to the stream server as to which jackpot controller to pass the coin-in data for that particular game cycle. As noted above, disabling and enabling the 'change jackpot' button could be achieved by having one stream of jackpot values rendered with the button grayed out and another stream rendered with the button highlighted. Alternatively, one of a pair of streams for the 'change jackpot' button could be sent to each stream decoder depending on the button state at each EGM. Both approaches would allow the button to be animated. Also, as noted above, when the maximum concurrent number of users of the menu system is reached, all stream decoders would be sent the disabled "change jackpot" button stream until a menu instance becomes available.

Thus, with this system or method, player selectable progressive jackpot links with associated bonus games are provided. The approach can use existing jackpot controller infrastructure, such that there need be no re-configuration of jackpot controllers to add and remove EGMs from links. A relatively cheap, optimized streaming solution requiring a minimum number of streams used, and no expensive client requirement, is thereby provided.

Moreover, in one approach, existing or newly developed jackpot controller hardware can be employed as well as new or existing DM technology, and a streaming decoder such as a Nvidia Tegra 2. Also, a streaming server based around a suitable compression codec that is low in CPU/GPU load and can generate 2 streams per jackpot link plus as many menu streams can be employed as desired.

The foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

When logic is implemented as software and stored in memory, one skilled in the art will appreciate that logic or information, can be stored on any computer readable medium for use by or in connection with any computer and/or processor related system or method. In the context of this document, a memory is a computer readable medium that is an electronic, magnetic, optical, or other another physical device or means that contains or stores a computer and/or processor program. Logic and/or the information can be embodied in any computer readable medium for use by or in connection with an instruction execution system, apparatus, or device, such as a computer-based system, processor-containing system, or other system that can fetch the instructions from the instruction execution system, apparatus, or device and execute the instructions associated with logic and/or information.

In the context of this specification, a "computer readable medium" can be any means that can store, communicate, propagate, or transport the program associated with logic and/or information for use by or in connection with the instruction execution system, apparatus, and/or device. The computer readable medium can be, for example, but not limited to, an electronic, magnetic, optical, electromagnetic, infrared, or semiconductor system, apparatus, device, or propagation medium. More specific examples (a non-exhaustive list) of the computer readable medium would include the following: an electrical connection having one or more wires, a portable computer diskette (magnetic, compact flash card, secure digital, or the like), a random access memory (RAM), a read-only memory (ROM), an erasable programmable read-only memory (EPROM, EEPROM, or Flash memory), an optical fiber, and a portable compact disc read-only memory (CDROM). Note that the computer-readable medium, could even be paper or another suitable medium upon which the program associated with logic and/or information is printed, as the program can be electronically captured, via for instance optical scanning of the paper or other medium, then compiled, interpreted or otherwise processed in a suitable manner if necessary, and then stored in memory.

In addition, those skilled in the art will appreciate that certain mechanisms of taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

Various aspects of the systems, methods, functions, steps, features and the like corresponding thereto disclosed herein may be implemented on one or more computer systems using hardware, software, firmware, circuits, or combinations thereof. Hardware, software, firmware, and circuits respectively refer to any hardware, software, firmware, or circuit component. Computer systems referred to herein may refer to any computing device and vice versa (e.g., smart phone, mobile computing device, personal data assistant, tablet computer, laptop computer, desktop computer, gaming machine, other computing device, and the like). For example, each computer system or computing device in the systems described herein or any embodiment of a system disclosed herein may utilize one or more of the following components: a single-core or multi-core hardware processor (e.g., central processing unit or graphics processing unit) on which software instructions are executed (e.g., instructions corresponding to an operating system, an application program, an interpreter such as a virtual machine, or a compiler); a memory associated with and in connection with the hardware processor such as cache or other system memory that stores software instructions or other data that the hardware processor may access for processing; an input device (e.g., mouse, keyboard, touchscreen, and the like); an output device (e.g., display, touchscreen, printer, and the like); a network or communication interface that enables the computer system to communicate over a network or communication protocol; an application program having corresponding software instructions that are executable by a hardware processor. Connections between different computer systems and connections between different computer system components may be wired or wireless.

Virtualization computing techniques, cloud computing techniques, web application/website computing techniques, traditional and adaptive streaming techniques, and other computing techniques may be implemented by any embodiment of a system disclosed herein to enable and/or enhance the teachings described herein. For example, in a cloud computing embodiment, one or more servers (i.e., one or more computer systems) may store and execute software instructions corresponding to an application program based on input data received from client devices. In response to the input data received, the application program is executed accordingly, which results in graphical data being processed and output to the client devices for display on a display such as a touch screen on a smart phone or tablet computer.

As another example, in a web application or website embodiment, data representative of a user input may be transmitted to a server (i.e., a computer system) hosting the website for processing and storage in memory. In an application program embodiment, the application may be stored and executed locally on a user's computer system. In other embodiments, one or more components of the application program may be stored and executed on a server and the user's computer system. For example, a user may download the application program from an app store for an Android computing device, Blackberry computing device, Apple computing device, Windows computing device, Samsung computing device, other computing device, and the like. Execution of the application program on the user's computing device may require that the device transmit and receive data to and from one or more computing devices such as a server or other user's computing device. For example, an application may be downloaded from a server to a mobile device. Upon installation, the mobile device may communicate with a server, such as a gaming server.

One or more embodiments of the systems disclosed herein may utilize streaming technology. Streaming data enables data to be presented to the user of the client device while the client device receives data from the server. Streaming data from servers to client devices (e.g., computing devices operated by users) over a network is typically limited by the bandwidth of the network, or alternatively, the physical layer net bitrate. Traditional streaming protocols, such as RTSP (Real-Time Streaming Protocol), MS-WMSP (Windows Media HTTP Streaming Protocol), and RTMP (Real Time Messaging Protocol) may be implemented, which essentially send data in small packets from the server to the client device in real-time at the encoded bitrate of the data. Adaptive streaming may also be implemented. Adaptive streaming almost exclusively relies on HTTP for the transport protocol. Similar to traditional streaming, data is encoded into discrete packets of a particular size; however, the source data is encoded at multiple bitrates rather than a single bitrate. The data packets corresponding to the same data encoded at different bitrates are then indexed based on the bitrate in memory. This streaming method works by measuring, in real-time, the available bandwidth and computer capacity of the client device, and adjusts which indexed data packet to transfer based on the encoded bitrate.

One or more aspects of the systems disclosed herein may be located on (i.e., processed, stored, executed, or the like; or include one or more hardware or software components) a single computer system or may be distributed among a plurality of computer systems attached by one or more communication networks (e.g., internet, intranet, a telecommunications network, and the like). One or more components of a computer system may be distributed across one or more computer systems in communication with the computer system over a communication network. For example, in some embodiments, the systems disclosed herein may utilize one or more servers (i.e., one or more computer systems dedicated for a particular purpose in the system) that may be dedicated to serve the needs of one or more other computer systems or components across a communication network and/or system bus. The one or more servers may provide a central processing location for one or more aspects of the systems disclosed herein.

Again, various aspects of the systems, methods, function, and steps corresponding thereto disclosed herein may be implemented on one or more computer systems using hardware, software, firmware, or combinations thereof. Those of ordinary skill in the art will appreciate that one or more circuits and/or software may be used to implement the system and methods described herein. Circuits refer to any circuit, whether integrated or external to a processing unit such as a hardware processor. Software refers to code or instructions executable by a computing device using any hardware component such as a processor to achieve the desired result. This software may be stored locally on a processing unit or stored remotely and accessed over a communication network.

As disclosed herein, a processor or hardware processor may refer to any hardware processor or software processor. A software processor may include or otherwise constitute an interpreter that is executed by a hardware processor. A computer system according to any embodiment disclosed herein is configured to perform any of the described functions related to the various embodiments of the systems disclosed herein.

As disclosed herein, any method, function, step, feature, or result may be considered a module that may include software instructions that cause, when executed by a computing device, the desired method, function, step, feature, or result. Executed by a computing device includes execution by any hardware component (e.g., CPU, GPU, network interface, integrated circuits, other hardware components, and the like) of the computing device such as a hardware processor. Any module may be executed by a computing device (e.g., by a processor of the computing device). Any method, function, step, feature, result, and the like disclosed herein may be implemented by one or more software modules whether explicitly described or not. Individual components within a computing device may work together to accomplish a desired method, function, step, feature, or result. For example, a computing device may receive data and process the data. A simple example would be that a network interface receives the data and transmits the data over a bus to a processor.

Various aspects of the systems disclosed herein may be implemented as software executing in a computer system. The computer system may include a central processing unit (i.e., a hardware processor) connected to one or more memory devices, a graphical processing unit, input devices such as a mouse and keyboard, output devices such as speakers and a display, a network interface to connect to one or more other computer systems (e.g., one or more computer systems configured to provide a service such as function as a database), an operating system, a compiler, an interpreter (i.e., a virtual machine), and the like. The memory may be used to store executable programs and data during operation of the computer system. The executable programs may be written in a high-level computer programming language, such as Java or C++. Of course, other programming languages may be used since this disclosure is not limited to a specific programming language or computer system. Further, it is to be appreciated that the systems and methods disclosed herein are not limited to being executed on any particular computer system or group of computer systems.

Some methods, functions, steps, or features have been described as being executed by corresponding software by a processor. It is understood than any methods, functions, steps, features, or anything related to the systems disclosed herein may be implemented by hardware, software (e.g., firmware), or circuits despite certain methods, functions, steps, or features having been described herein with reference to software corresponding thereto that is executable by a processor to achieve the desired method, function, or step. For example, as disclosed herein, touch devices such as a virtual button deck may provide sensory feedback to a player. The virtual button decks may transmit information related to the sensory feedback and a player's interaction with the virtual button deck to one or more processors. The one or more processors may be any electrical hardware unit, such as but not limited to an integrated circuit, a display manager, a central processing unit, a graphics processing unit, or any other processing unit.

It is understood that software instructions may reside on a non-transitory medium such as one or more memories accessible to one or more processors in the systems disclosed herein. For example, where a computing device receives data, it is understood that the computing device processes that data whether processing the data is affirmatively stated or not. Processing the data may include storing the received data, analyzing the received data, and/or processing the data to achieve the desired result, function, method, or step. It is further understood that input data from one computing device or system may be considered output data from another computing device or system, and vice versa. It is yet further understood that any methods, functions, steps, features, results, or anything related to the systems disclosed herein may be represented by data that may be stored on one or more memories, processed by one or more computing devices, received by one or more computing devices, transmitted by one or more computing devices, and the like.

The various embodiments and examples described herein are provided by way of illustration only and should not be construed to limit the claimed subject matter, nor the scope of the various embodiments and examples. Those skilled in the art will readily recognize various modifications and changes that may be made to the claimed subject matter without following the example embodiments and applications illustrated and described herein, and without departing from the true spirit and scope of the claimed subject matter, which is set forth in the following claims. In addition, various embodiments may be combined. Therefore, reference to an embodiment, one embodiment, in some embodiments, in other embodiments, and the like does not preclude one or more methods, functions, steps, features, results, hardware implementations, or software implementations of different embodiments from being combined. Further, reference to an embodiment, one embodiment, in some embodiments, in other embodiments, examples, and the like provides various aspects that may or may not be combined with those of one or more different embodiments and/or examples.

The present disclosure is further directed to a method or system including a computer readable medium and a data structure stored thereon adapted and configured to route signals. The data structure includes a computer readable system for a gaming or game system including a processing system configured and adapted to communicate with a plurality of computers and functions and sub-functions thereof. The gaming or game system or method includes a processing system arranged to accept input and create output to achieve decoupling of bonus features from base games and to provide player selectable bonus features.

Although the disclosure has been described in language specific to computer structural features, methodological acts, and by computer readable media, it is to be understood that the subject matter defined in the appended claims is not necessarily limited to the specific structures, acts, or media described. Therefore, the specific structural features, acts and mediums are disclosed as exemplary embodiments implementing the claimed subject matter.

From the foregoing it will be appreciated that, although specific embodiments have been described herein for purposes of illustration, various modifications may be made without deviating from the spirit and scope of the teachings. Accordingly, the claims are not limited by the disclosed embodiments.

What is claimed:

1. A system for players of electronic gaming machines on a communication network to select between different first and second progressive jackpots, each gaming machine configured for accepting coin-in wagers to play a base game displayed at a touch screen video display on the gaming machine and including video mixing apparatus and a video stream decoder, the progressive jackpots awarded independent of any outcome of the base game, the system comprising:

a jackpot controller in communication with gaming machines over the network and configured to (a) receive coin-in wager signals for all gaming machines playing either of the different first and second progressive jackpots over the network (b) receive selection signals from one or more electronic gaming machines to select between (i) a link with the first progressive jackpot or (ii) a link with the second progressive jackpot and (c) accumulate coin-in wager signals from the one or more electronic gaming machines linked to the first progressive jackpot to the first progressive jackpot;

a stream server in communication with the jackpot controller and each electronic gaming machine video mixing and video stream decoder and configured to send signals to mix the video display to display the base game in an area defining most of the video display with display of (a) the current values for each of the first and second progressive jackpots and (b) a touch enabled button for the player to touch to send the selection signal;

the jackpot controller further configured to detect a first progressive jackpot trigger condition related to the coin-in wagers from the electronic gaming machines linked thereto and issue a jackpot trigger condition for a bonus;

in response to detection of the trigger condition the stream server configured to control the video mixing apparatus and video stream decoder to control the video display to display a progressive award video sequence at a location of the video display in place of at least a portion of the area for the base game;

wherein the jackpot controller accumulates coin-in information from all electronic gaming machines so that no dynamic reconfiguration is necessary when a player switches their selection from linking with the first progressive jackpot to the second progressive jackpot.

2. The system of claim 1 comprising in response to detection of the trigger condition the stream server configured to control the video mixing apparatus and video stream decoder to control the entire video display to display a progressive award video sequence.

3. The system of claim 1 comprising the video mixing apparatus is display manager including a touch router to manage touches between the base game and the touch enabled button.

4. The system of claim 1 wherein the base game for an electronic gaming machines has a base game return to player and each of the first and second progressive jackpots has a bonus return to player, the jackpot controller configured to enable linking between the electronic gaming machine and the first progressive jackpot if the base game return to player and the bonus game return to player are compatible.

5. A system for players of electronic gaming machines on a communication network to select to link to different first and second progressive jackpots, each gaming machine configured for accepting coin-in wagers to play a base game displayed at a touch screen video display on the gaming machine and including video mixing apparatus and a video stream decoder, the progressive jackpots awarded independent of any outcome of the base game, the system comprising:

first and second jackpot controllers to control the first and second jackpots in communication with gaming machines over the network and each configured to (a) receive coin-in wager signals for all gaming machines playing either of the first and second progressive jackpots over the network (b) receive selection signals from one or more electronic gaming machines to select between (i) a link with the first progressive jackpot or (ii) a link with the second progressive jackpot and (c) accumulate coin-in wager signals from the one or more electronic gaming machines linked to the first progressive jackpot to the first progressive jackpot;

a stream server in communication with the jackpot controller and each electronic gaming machine video mixing and video stream decoder and configured to send signals to mix the video display to display the base game in an area defining most of the video display with display of (a) the current values for each of the first and second progressive jackpots and (b) a touch enabled button for the player to touch to send the selection signal;

the jackpot controller further configured to detect a first progressive jackpot trigger condition related to the coin-in wagers from the electronic gaming machines linked thereto and issue a jackpot trigger condition for a bonus;

in response to detection of the trigger condition the stream server configured to control the video mixing apparatus and video stream decoder to control the video display to display a progressive award video sequence at a location of the video display in place of at least a portion of the area for the base game;

wherein the jackpot controller accumulates coin-in information from all electronic gaming machines so that no dynamic reconfiguration is necessary when a player switches their selection from linking with the first progressive jackpot to the second progressive jackpot.

6. The system of claim 5 comprising the video mixing apparatus is display manager including a touch router to manage touches between the base game and the touch enabled button.

7. The system of claim 5 wherein the base game for an electronic gaming machines has a base game return to player and each of the first and second progressive jackpots has a bonus return to player, the jackpot controller configured to enable linking between the electronic gaming machine and the first progressive jackpot if the base game return to player and the bonus game return to player are compatible.

* * * * *